US005657115A

United States Patent [19]

Sugihara

[11] Patent Number: 5,657,115

[45] Date of Patent: Aug. 12, 1997

[54] ROTARY DEVELOPING DEVICE FOR AN IMAGE FORMING APPARATUS

[75] Inventor: Kazuyuki Sugihara, Tokohama, Japan

[73] Assignee: Ricoh Company, Ltd., Tokyo, Japan

[21] Appl. No.: 554,576

[22] Filed: Nov. 6, 1995

[30] Foreign Application Priority Data

Nov. 4, 1994 [JP] Japan ..... 6-295798

[51] Int. Cl.[6] ..... G03G 15/01; G03G 15/08

[52] U.S. Cl. ..... 399/263; 222/DIG. 1; 366/323; 399/223

[58] Field of Search ..... 355/326 R, 327, 355/245, 260; 222/DIG. 1; 366/88, 89, 90, 322, 323

[56] References Cited

U.S. PATENT DOCUMENTS 4,136,969 1/1979 Meyer ..... 366/88
4,821,075 4/1989 Saito et al. ..... 355/260 X
5,109,254 4/1992 Oka et al. ..... 222/DIG. 1
5,512,984 4/1996 Kimura et al. ..... 355/245

FOREIGN PATENT DOCUMENTS 4-60565 2/1992 Japan .

*Primary Examiner*—Arthur T. Grimley
*Assistant Examiner*—Sophia S. Chen
*Attorney, Agent, or Firm*—Oblon, Spivak, McClelland, Maier & Neustadt, P.C.

[57] ABSTRACT

In an image forming apparatus, a rotary developing device has a developing unit in which a plurality of developing chambers are arranged around an axis of rotation. The developing unit is rotated about the axis to bring one of the chambers to a developing position where an image carrier is located. In each of the chambers, part of a developer removed by a doctor blade is received by a guide and then released from the guide into the chamber. This part of the developer is agitated in the vertical direction and conveyed together with the developer existing in the chamber by the rotation of the device. As a result, the developer is agitated, conveyed and charged in a desirable manner.

12 Claims, 11 Drawing Sheets

ROTARY DEVELOPING DEVICE FOR AN IMAGE FORMING APPARATUS

BACKGROUND OF THE INVENTION

1. Cross-Reference to Related Applications

The present application is related to co-pending U.S. application Ser. No. 08/459,423.

2. Field of the Invention

The present invention relates to a developing device for a copier, facsimile apparatus, printer or similar image forming apparatus and, more particularly, to an improvement in the agitation, conveying and charging of a developer in a rotary developing device having a developing unit in which a plurality of developing chambers are arranged around an axis of rotation, and rotating the unit about the axis to locate any one of the chambers at a developing position where an image carrier is located.

3. Discussion of the Related Art

A rotary developing device, or revolver as generally referred to, is disclosed in Japanese Patent Laid-Open Publication Nos. 62-251772 and 63-78170 by way of example. The revolver is made up of a rotary developing unit, a rotary developer storing unit, and conveying means. The developing unit has a plurality of developing sections or chambers arranged around an axis of rotation. A plurality of storing chambers are defined in the storing unit in one-to-one correspondence with the developing chambers. The conveying means conveys a developer from the respective storing chamber to the associated developing chamber. The developing unit, storing unit and conveying means are rotated about the axis integrally to bring one of the developing chambers to a developing position where an image carrier is located. This developing device will be referred to as Related Art 1.

Japanese Patent Publication No. 64-8330 and Japanese Patent Laid-Open Publication No. 61-243467, for example, teach a revolver in which the developing unit and the developer storing unit are configured independently of each other, and only the developing unit is rotatable. In this revolver, the conveying means for conveying the developer from the storing unit has its end implemented as a structural body unrotatably disposed in a bore formed at the center of the developing unit. The developer is dropped from an outlet formed in the bottom of the structural body into a developing chamber by gravity. This developing device will be referred to as Related Art 2.

Assume that any one of the above revolvers is loaded with developers of different colors in order to form a full-color image. Then, the developing chambers of the developing unit must be sequentially replaced during the course of image formation. This brings about a problem that the developer in each developing chamber cannot be sufficiently agitated, and a problem that the charge deposited on the developer fed from the storing chamber to the developing chamber is short. The short agitation results in an irregular density distribution of an image while the short charge contaminates the background of an image and causes the developer to fly about.

To eliminate these problems, previously mentioned Publication No. 64-8330 proposes to subdivide each developing chamber into two compartments by a partition. An agitating screw is disposed in each of the compartments. An opening is formed in opposite ends of the partition to provide communication between the compartments. The screws in the compartments are driven to circulate a developer through the compartments via the openings of the partition. The developer dropped from the outlet of the structural body is received in one of the compartments and mixed and agitated with the existing developer to a certain degree. The resulting mixture is transferred to the other compartment where a developing roller is positioned. The above document also proposes to move the developer, fed from the outlet into the chamber located just below the outlet, to a developing position different from such a position and where an image carrier is located. This kind of scheme allows the replenished developer to be mixed with the existing developer and charged to a certain degree before it arrives at the developing position. Hence, even immediately after the replenishment, it is possible to effect development at the developing position without irregularity.

Laid-Open Publication No. 61-243467 also mentioned previously proposes to mount on the apparatus body an exclusive developing roller driveline which faces the chamber brought to the above-stated position just below the outlet. The exclusive driveline drives the developing roller of the chamber in order to agitate the replenished developer together with the existing developer within the chamber.

In the structure taught in Publication No. 64-8330, when the relation between the two compartments is inverted in the up-and-down direction due to the rotation of the developing unit, the developer is agitated in the vertical direction during the movement from the upper compartment to the lower compartment. However, because the vertical agitation occurs via the openings at opposite ends of the partition with respect to the widthwise direction, irregular development is apt to occur in the widthwise direction unless the developer is sufficiently agitated in the above direction, i.e., horizontal direction afterwards. Assume that the developer dropped from the outlet of the structural body is directly replenished into one compartment and mixed with the existing developer by the screw, as also taught in the above document. Then, it is likely that the charge deposited on the replenished developer is short because of the agitation efficiency lower than in the case the developer is agitated in a tube or similar limited space. Further, assume that the developer replenished into the chamber just below the outlet is moved to the developing position remote from such a position, as further taught in the above document. This configuration, however, needs a special structure as discussed in relation to Related Art 2 and does not give any consideration to the application to Related Art 1 having a different basic structure.

In the scheme for agitating the replenished developer in the chamber located just below the outlet, as taught in previously mentioned Laid-Open Publication No. 61-243467, the exclusive driveline is mounted on the apparatus body. This increases the number of positions where the developing unit and the drive system on the apparatus body engage and disengage during the rotation of the revolver, aggravating the vibration of the revolver. Another problem with this scheme is that sufficient agitation is not attainable, depending on the rotation speed of the developing roller driven by the exclusive driveline.

SUMMARY OF THE INVENTION

It is, therefore, an object of the present invention to provide a rotary developing device capable of agitating a developer in a desirable manner by the rotation of a developing unit.

It is another object of the present invention to provide for a rotary developing device of the type which rotates, integrally about a single axis, a developing unit, a developer storing unit and conveying means for conveying a developer from the developer storing chambers of the storing unit to the developing chambers of the developing unit, which device can replenish a developer into the developing chamber not located at a developing position from the associated storing chamber.

It is still another object of the present invention to provide for a rotary developing device capable of agitating a developer in a developing chamber not located at a developing position without aggravating vibration.

It is a further object of the present invention to provide for a rotary developing device capable of agitating a developer sufficiently in a developing chamber not located at a developing position, and thereby effecting desirable development when the chamber is brought to the developing position.

In accordance with the present invention, in a rotary developing device in which a developing unit having a plurality of developing chambers arranged around the axis of rotation is rotatable about the axis to move any one of the developing chambers to a developing position where an image carrier is located, the developing chambers each has a developer carrier, a regulating member for regulating the amount of a developer deposited on and being conveyed by the developer carrier toward the developing position, a guide member having an opening identical in width as the regulating member, and for receiving the developer removed from the developer carrier by the regulating member, and a conveying member for conveying the developer received by the guide member along the guide member.

Also, in accordance with the present invention, a rotary developing device has a developing unit having a plurality of developing chambers arranged around the axis of rotation, and rotatable about the axis to move any one of the developing chambers to a developing position where an image carrier is located. A developer storing unit has a plurality of developer receptacles respectively corresponding to the developing chambers. A conveying member conveys a developer from each of the developer receptacles to one of the developing chambers. A rotatable hollow member is disposed in each of the developing chambers and formed with a plurality of agitating blades, each extending over the width of an effective developing range, at predetermined circumferential intervals. The conveying member extends in the hollow member over the above width. The hollow member is formed with developer outlets in the circumferential wall thereof.

Further, in accordance with the present invention, a rotary developing device has a developing unit having a plurality of developing chambers arranged around the axis of rotation, and rotatable about the axis to move any one of the developing chambers to a developing position where an image carrier is located. A developer storing unit has a plurality of developer receptacles respectively corresponding to the plurality of developing chambers. A conveying member conveys a developer from each of the developer receptacles to one of the developing chambers. The conveying member is arranged such that at least at one position other than the developing position, part of the conveying member of one developing chamber located at the above position is located in the developer receptacle at a position where the developer is present. The developer is replenished into the developing chamber located at the above position.

Furthermore, in accordance with the present invention, a rotary developing device in which a developing unit having a plurality of developing chambers arranged around the axis of rotation and each having a developer agitating member thereinside is rotatable about the axis to locate any one of the developing chambers at a developing position where an image carrier is located has a drive inputting device for inputting a driving force to one of the developing chambers located at the developing position. A drive transmitting device transmits, at the developing unit side, the driving force to at least one of the developing chambers not located at the developing position.

Moreover, in accordance with the present invention, in a rotary developing device in which a developing unit having a plurality of developing chambers arranged around the axis of rotation and each having a developer agitating member thereinside is rotatable about the axis to locate any one of the developing chambers at a developing position where an image carrier is located, the developer agitating device of one of the developing chambers located at the developing position and the developer agitating member of at least one of the other developing chambers are drivable. The developer agitating member of the developing chamber not located at the developing position has a higher agitation speed than the developer agitating member of the developing chamber located at the developing position.

The present invention also provides for a rotary developing device which comprises a developing unit, a developer storing unit and conveying means. A rotatable hollow member is disposed in each of the plurality of developing chambers and formed with a plurality of agitating blades. Each of the agitating blades extending over a width of an effective developing range, at predetermined circumferential intervals, wherein the conveying means extends in the hollow member over the width, and wherein the hollow member is formed with developer outlets in a circumferential wall thereof. The rotatable hollow member further comprises screw means which extend along the width of the effective developing range.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 4(*b*) shows the lower screw arrangement;

FIG. 4(*c*) shows a screw and paddle arrangement;

FIGS. 4(*d*) and 4(*e*) are further views of the lower screw;

FIG. 5(*b*) shows a bias applying mechanism;

DESCRIPTION OF THE PREFERRED EMBODIMENTS

Figure 1:
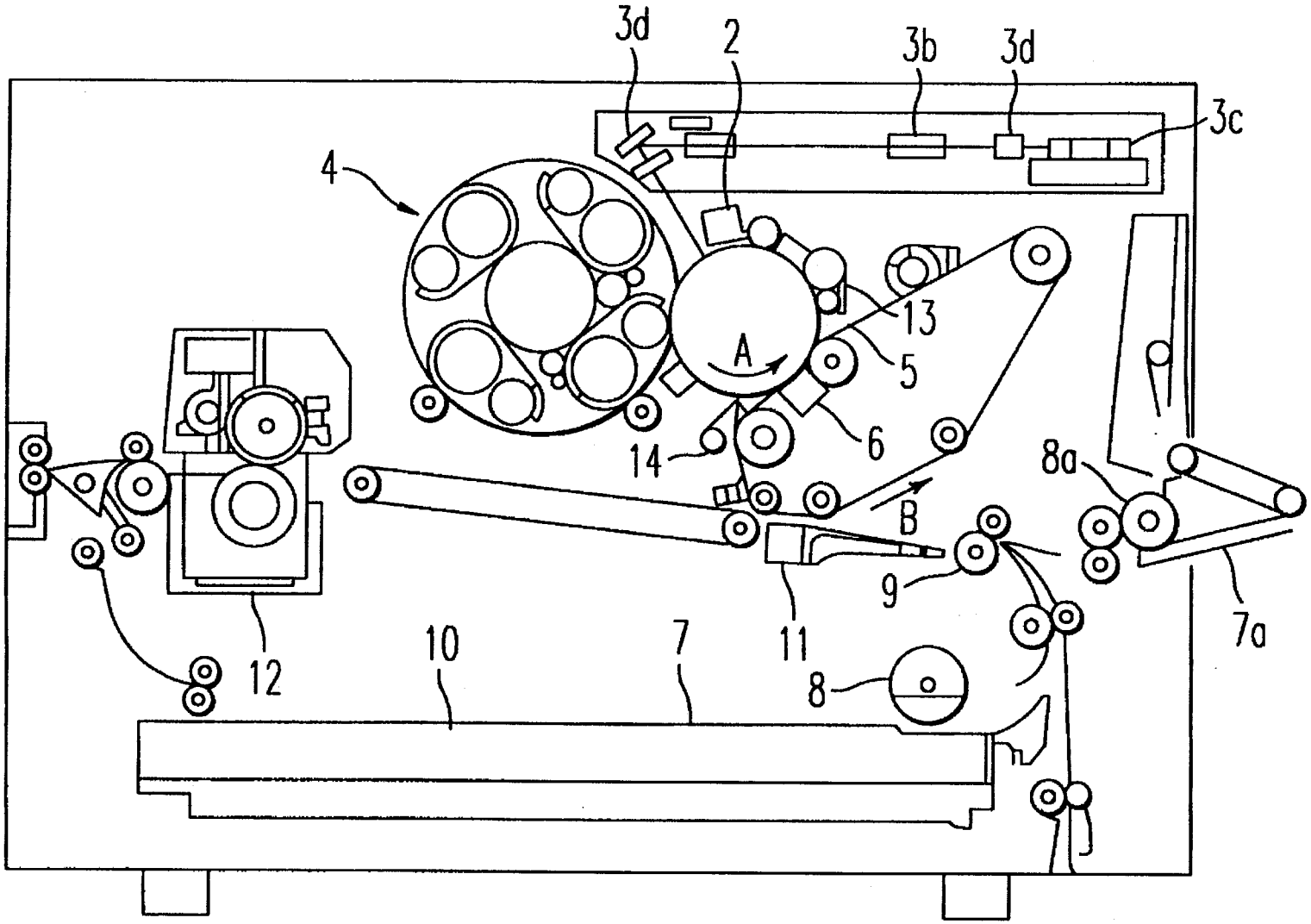
FIG. 1 is a section showing an image forming apparatus to which a rotary developing device embodying the present invention is applied.

Referring now to the drawings, wherein like reference numerals designate identical or corresponding parts throughout the several views, FIG. 1 illustrates an image forming apparatus to which a rotary developing device embodying the present invention is applied and implemented as an electrophotographic color printer. As shown, the printer has a photoconductive drum, or image carrier 1 which is rotated in a direction indicated by an arrow A in the figure. A main charger 2 uniformly charges the surface of the drum 1. Laser optics 3 including lens elements 3*a*–3*d* scan the charged surfaces of the drum 1 in accordance with image data and thereby electrostatically forms a latent image thereon. The image data consist of yellow data, magenta data, cyan data and black data generated by separating a desired full-color image. Latent images sequentially formed on the drum 1 are each developed by one of yellow toner, magenta toner, cyan toner and black toner stored in a rotary developing device or revolver 4 which will be described. As a result, the latent images are transformed to toner images of respective colors.

An intermediate transfer belt 5 is rotated in synchronism with the drum 1 in a direction B. The toner images formed on the drum 1 are sequentially transferred to the belt 5 by a primary transfer charger 6 one above the other, thereby forming a composite color image. A paper 10 is fed from a duplex copy/automatic paper feed cassette 7 or a manual paper feed tray 7*a* to an image transfer position by a pick-up roller 8 or 8*a* and a registration roller pair 9. A secondary transfer charger 11, located at the image transfer position, transfers the composite color image from the belt 5 to the paper 10. A fixing unit 12 fixes the color image on the paper 10. The paper 10 with the color image is driven out of the printer as a full-color printing. A drum cleaner 13 removes the toner remaining on the drum 1 after the image transfer. Likewise, a belt cleaner 14 removes the toner remaining on the belt 5 after the image transfer.

Figure 2:
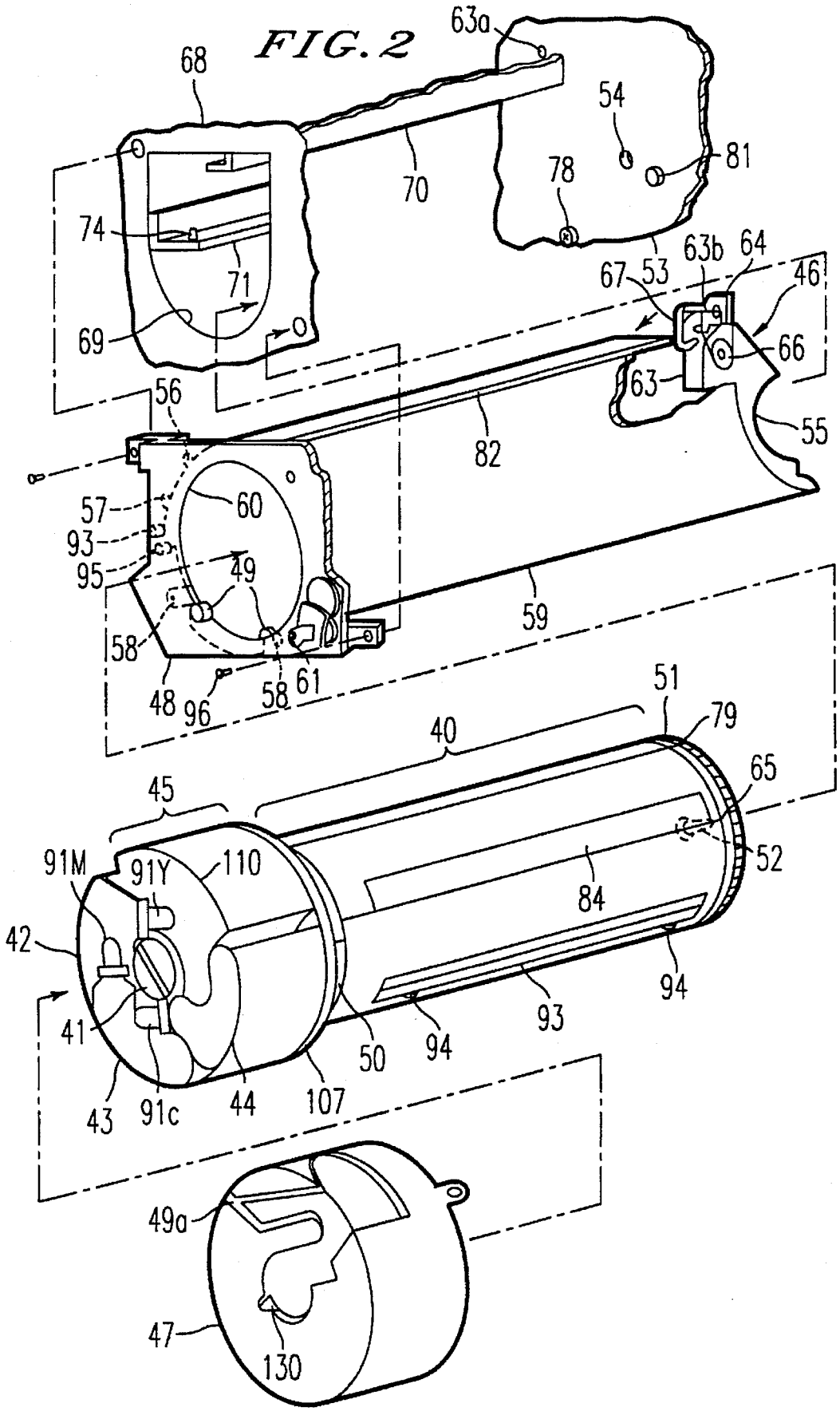
FIG. 2 is an exploded external perspective view of the embodiment.

As shown in FIG. 2, the revolver 4 embodying the present invention has a substantially cylindrical developing unit 40 and a toner storing unit 45. The developing unit 40 is rotatable about its own axis and has four developing sections or chambers therein which are assigned to, for example, black, cyan, yellow, and magenta, respectively. The toner storing unit 45 is coaxial with and located at the front of the developing unit 40. Four toner containers 41, 42, 43 and 44 are removably mounted to the storing unit 45 and held in one-to-one correspondence with the four developing chambers of the developing unit 40. The toner containers 41–44 store black toner, yellow toner, magenta toner, and cyan toner, respectively. The storing unit 45 is rotatable integrally with the developing unit 40. A casing 46 supports the developing unit and storing unit 45, i.e., the revolver and is slidable relative to the printer body substantially in parallel to the axis of the revolver. A cover 47, which is not rotatable, covers the storing unit 45.

Two support rollers 49, for example, are mounted on the front support wall 48 of the casing 46. The developing unit 40 has a front wall 50 and a rear wall 51 each having a disk-like configuration. The front wall 50 is supported by the support rollers 49. A tapered center shaft 52 extends out from the center of the rear wall 51 and rotatably received in a hole 54 formed in a rear panel 53 forming part of the printer body. In this condition, the revolver is rotatable in the printer body and positioned such that the axis thereof is parallel to the axis of the drum 1 substantially in the same plane, as shown in FIG. 1.

A mechanism for rotatably supporting the revolver will be described with reference to FIG. 2. As shown, the casing 46 has, in addition to the front support wall 48, a rear support wall 55 and a side cover 59. The side cover 59 is affixed to the support walls 48 and 55 at opposite ends thereof and reinforced by tie rods 56, 57 and 58. An opening 60 is formed through the front support wall 48 for receiving the revolver. A motor 61 and a gear train 62 (see FIG. 6) are also mounted on the support wall 48. The motor 61 drives via the gear train 62 toner supply rollers which are disposed in the toner storing unit 45. An intermediate plate 63 is disposed in the casing 46 and supported by the tie rods 56 and 57 in the vicinity of the rear support wall 55. A positioning pin 63*b* is studded on the plate 63 and received in a positioning hole 63*a* formed in the rear panel 53. A bracket 64 is rotatably mounted at one end thereof on the part of the pin 63*b* intervening between the plate 63 and the rear support wall 55. A positioning roller 66 is mounted on the other end of the bracket 64. The roller 66 falls in any one of a plurality of (four in the embodiment) recesses 65 formed in the outer periphery of the rear end wall of the developing unit 40. A spring 67 constantly biases the bracket 64 in a direction indicated by an arrow in FIG. 2.

A front panel 68 included in the printer body is formed with an opening 69 for receiving the casing 46 carrying the revolver therewith. An upper guide 70 and a lower guide 71 extend between the front panel 68 and the rear panel 53 of the printer body. The casing 46 is slidably supported by the guides 70 and 71. Specifically, the side cover 59 of the casing 46 has portions 72 and 73 to be guided by the guides 70 and 71 at the top and the side, respectively. A channel 75 is formed in the bottom of the portion 73 and receives an upright guide pin 74 studded on the guide 71. When the casing 46 is moved into and out of the printer body, the channel 75 causes it to move away from the drum 1. Also, when the casing 46 is fully set on the printer body, the channel 75 guides the revolver to a predetermined position relatively close to the drum 1. For this purpose, the channel 75 is bent such that a predetermined front portion thereof is closer to the drum 1 than a rear portion.

The positioning pin 63*b*, studded on the intermediate plate 63, has a tapered tip. The tapered tip begins to enter the hole 63*a* of the rear panel 53 immediately before the casing 46 is fully received in the printer body, and accurately positions the rear support wall 55 and bracket 64 of the casing 46 when the casing 46 is fully received. When the casing is not inserted in the printer body, the rear end of the revolver is supported by the rear support wall 55 of the casing 46. However, immediately before the casing 46 is fully received in the printer body, the tapered center shaft 52 begins to enter the hole 54 of the printer rear panel 53, sequentially raising the revolver. When the casing 46 is fully inserted into the printer body, the revolver is fully raised above the support wall 55. The front support wall 48 is affixed to the printer front panel 68 by, for example, screws 76 after the casing 46 has been inserted in the printer body. In this condition, the front end of the revolver is supported by the rollers 49 of the front support wall 48 which has been accurately positioned on the printer body. At the same time, the rear end of the revolver is rotatably positioned relative to the printer rear panel 53.

A revolver drive gear 78 is mounted on the printer rear panel 53 and driven by a stepping motor or similar revolver drive motor, not shown. The drive gear 78 is held in mesh with a revolver input gear 79 which can have a larger diameter than that of the gear 78 (see also FIG. 5(*a*)). The gear is fastened to the rear of the rear end wall of the developing unit 40. Also mounted on the printer rear panel 53 is a development drive gear 81 driven by a motor, not shown, to drive developing rollers 84 and other rotary bodies built in the developing unit 40 (see also FIGS. 3 and 5(*a*)).

The developing unit 40 will be described with reference to FIGS. 2 and 3. As shown, the developing unit 40 has, in addition to disk-like front and rear end walls 50 and 51, partition walls intervening between the front and rear walls. The partition walls consist of a hollow cylindrical portion 82 for receiving a cylindrical black toner container or bottle, and four casing portions 83, 83C, 83M and 83Y. The casing portions 83–83Y extend radially from the cylindrical portion 82 and partition the space around it into four developing chambers having substantially an identical shape. The chambers each store a mixture of carrier and toner of particular color, i.e., a two-component type developer. In the condition shown in FIG. 5(*a*), the chamber storing the black toner and carrier is shown as facing the drum 1 at the developing position. The chambers storing the yellow toner and carrier, magenta toner and carrier, and cyan toner and carrier, respectively, are sequentially arranged in this order in the counterclockwise direction, as viewed in the figure.

The following description will concentrate on the black developing chamber located at the developing position. The constituents of the other developing chambers are distinguished from the constituents of the black developing chamber and from each other simplify by suffixes Y, M and C.

In the black developing chamber, the casing part 83 is formed with an opening facing the drum 1. A developing roller 84 (84Y, 84M, 84C for the other developing chambers) is positioned in the chamber and partly exposed to the outside through the opening. Also disposed in the chamber are a doctor blade 85 (85Y, 85M, 85C for the other developing chambers), an upper screw 86 (86Y, 86M, 86C for the other developing chambers), and a guide 87 (87Y, 87M, 87C for the other developing chambers) for the screw 86 (86Y, 86M, 86C). The doctor blade 85 regulates the amount of toner to be conveyed by the roller 84 to the developing position. The upper screw 86 conveys part of the developer removed by the doctor blade 85 from the rear to the front along the axis thereof. The guide 87 is implemented as a top-open trough identical in width with the doctor blade 85 and contributes to the agitation of the developer in the chamber in the vertical direction, as will be more specifically described later.

A paddle 88 is also disposed in the developing chamber. For example, as shown in FIGS. 4(*a*)–4(*e*), the paddle 88 has a hollow cylindrical portion 89 formed with a plurality of developer outlets 89*a* extending in the axial direction of the roller 84, small holes 89*b*, a plurality of blades 90 extending radially from the portion 89 and a screw member 88*a*. The small holes 89*b* and outlets 89*a* can be seen in detail in FIGS. 4(*d*) and 4(*e*). A lower screw 91 is disposed in the portion 89 and conveys the developer along the axis thereof in the opposite direction to the screw 86. The casing portion is formed with an outlet 92 (92Y, 92M, 92C) below the lower screw 91 (91Y, 91M, 91C). The outlet 92 extends in the axial direction of the revolver and is selectively used to discharge a deteriorated developer or to replenish a fresh developer (with toner). A cap 93 (93Y, 93M, 93C) is fitted on the casing portion by, for example, a screw 94 (94Y, 94M, 94C) in order to close the outlet 92.

As shown in FIG. 4(*a*), the front ends of the upper and lower screws 86 and 91 extend out from the front end wall 50 of the developing unit. A drop section 96 is formed around the extensions of the screws 86 and 91. In the drop section 96, the developer conveyed by the screw 86 is dropped onto the screw 91 by gravity. In this configuration, the developer deposited on the roller 84 is partly removed by the doctor blade 85 and then conveyed to the front by the guide 87 and screw 86. At the drop section 96, this part of the developer is dropped onto the screw 91. The screw 91 conveys the developer into the effective width of the roller 84. As a result, the developer is discharged into the chamber via the outlets 89*a* and small holes 89*b* of the paddle 88. In this manner, the developer is agitated in the chamber in the horizontal direction. The developer discharged to the lower portion of the chamber via the outlets 89*a* is agitated by the screw or wing 88*a* and blades 90 of the paddle 88 in the vertical direction.

The front end of the screw 91 is further extended beyond the drop section 96 into one of receptacles 109Y, 109M, 109C and 110 respectively communicated to the developing chambers, more specifically to below toner supply rollers 97 respectively disposed in the receptacles 91Y–110. In this configuration, fresh toner from the toner storing unit 45 is introduced into the developer being agitated in the horizontal direction in the drop section 96. While the toner and developer are conveyed in the hollow cylindrical portion 89 of the paddle 88, the former is mixed with the latter and thereby fictionally charged. As shown in FIGS. 4(*d*) and 4(*e*), the developer outlets 89*a* may be distributed only over a range of from the intermediate point of the portion 89 to the downstream end in the direction in which the screw 91 conveys the developer, while the small holes 89*b* may be distributed upstream, with respect to the conveying direction of the screw 91, of the outlets 89*a*. This promotes an effective agitating time in the portion 89. When the portion 89 is rotated integrally with the lower screw 91 in order to simplify the driveline, the agitating is particularly effective in avoiding short agitation.

As illustrated in FIGS. 4(*a*)–4(*e*), the blades 90 act as an agitator for the developer while the screw member 88*a* acts as a conveyor. The screw member 88*a* extends along the lower screw 91 over a width which corresponds to the developing unit 40 and is formed as a screw as illustrated in FIGS. 4(*a*)–4(*e*). Thus, the combination of the blades 90 and the screw member 88*a* performs both an agitating and conveying function for the developer. This therefore provides for an improvement in conveyance speed with respect to conveying the charged developers quickly to the developing area.

The combination of the small holes 89*b* and the outlets 89*a* further promote a developer balance with respect to the lower screw 91. It is noted that the spacing and positioning of the small holes 89*b* and the outlets 89*a* are based on the desired developer balance along the lower screw 91. Also, the number and size of the small holes 89*b* are decided based on the desired developer balance along the lower screw 91. For example, if no small holes 89*b* are present, a little amount of toner is supplied in the front position of the paddle 88. On the other hand, if the small holes 89*b* have the same size as the outlets 89*a*, too much toner will be supplied in the front position.

Thus, the combination of the screw member 88*a* and the paddles 88 provide for an efficient agitation and charges the toners uniformly. This combination also improves the conveyance speed of the toner, so that charged toners are conveyed to the developing area quickly. The utilization of the small holes 89b and the openings 89a make the balance of the developer quantity in the developing unit uniform. These features also simplify the construction of the composition so as to minimize the size of the equipment.

Figure 3:
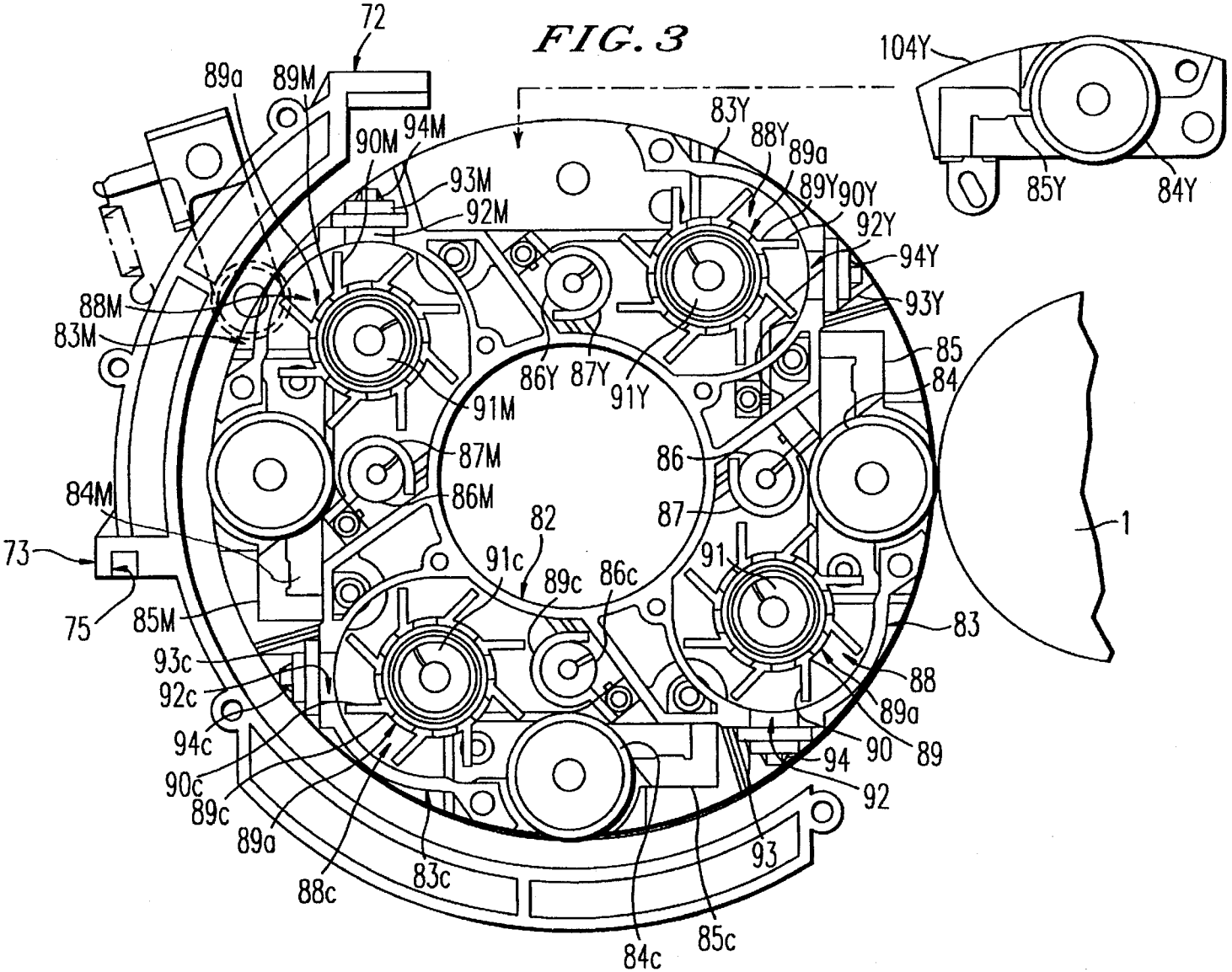
FIG. 3 is section of a developing unit included in the embodiment.
Figure 4A:
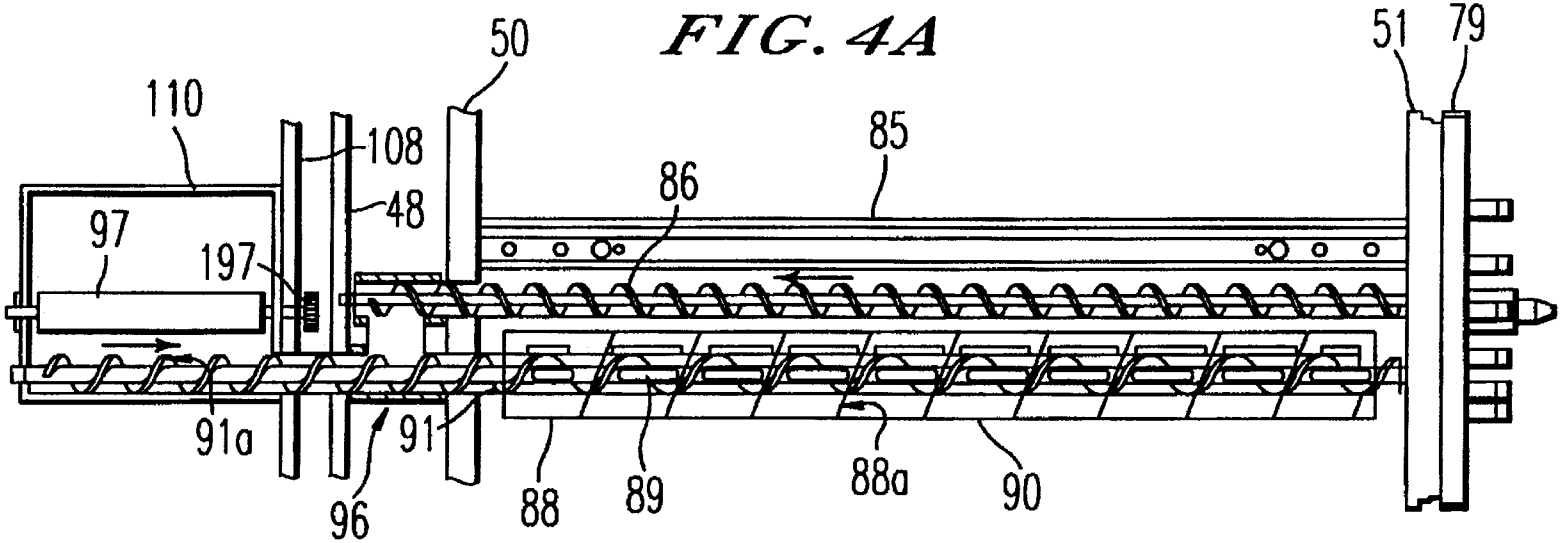
FIG. 4(*a*) is a vertical section in a plane containing the axis of upper and lower screws disposed in a black developing chamber.
Figure 4C:
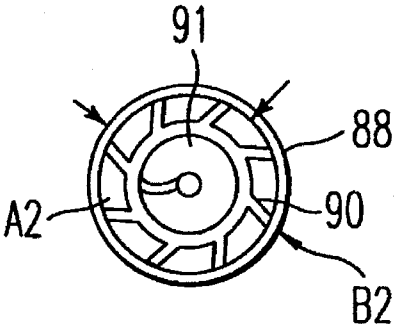
Figure 4B:
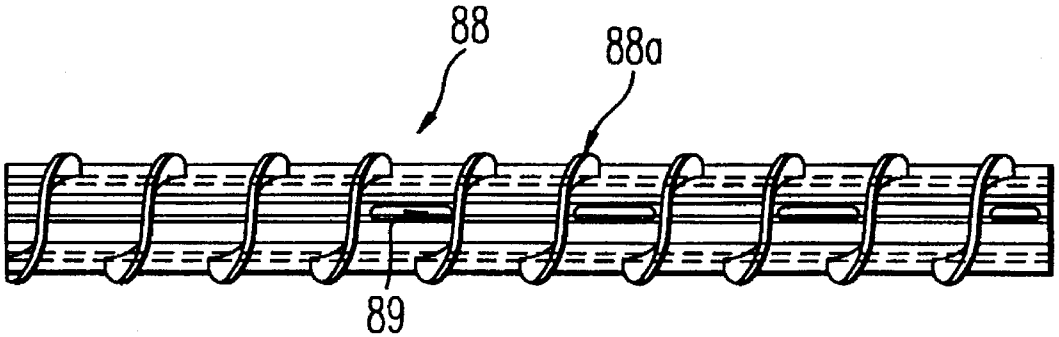
Figure 4D:
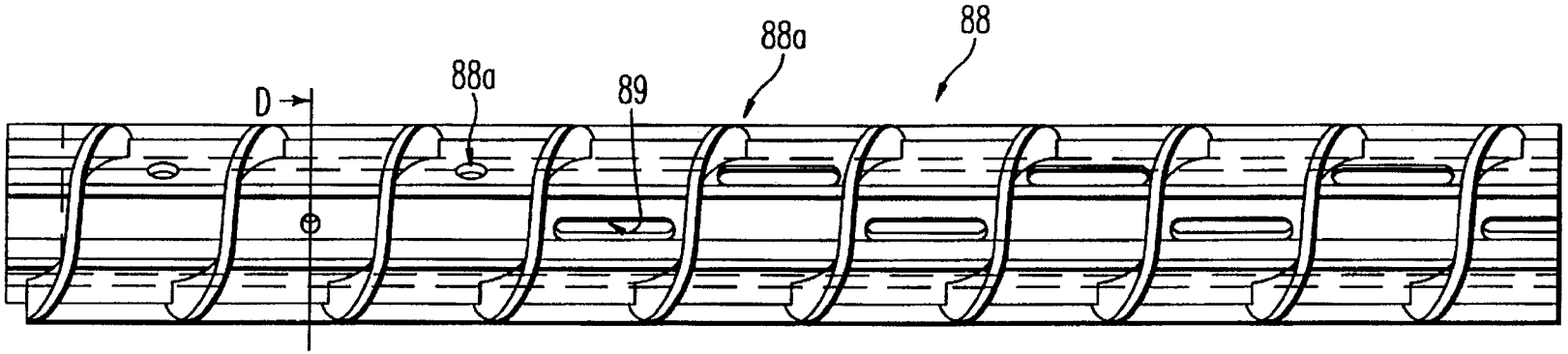
Figure 4E:
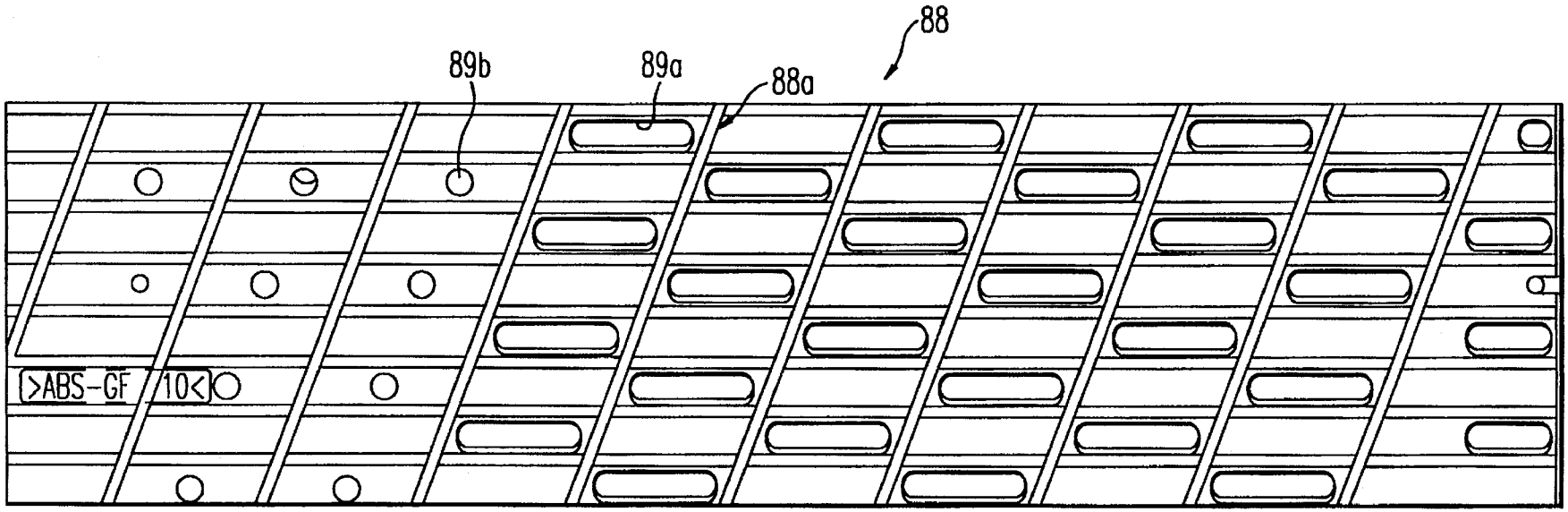

As shown in FIG. 3, the yellow developing unit, for example, has a developing roller 84Y and a doctor blade 85Y supported by front and rear small wall pieces 104Y which are separable from the other front and rear wall portions. When the chamber should be cleaned or when the parts should be replaced, the small wall pieces 104Y, carrying the roller 84Y and blade 85Y therewith, can be bodily removed to facilitate the access to the chamber.

Figure 5A:
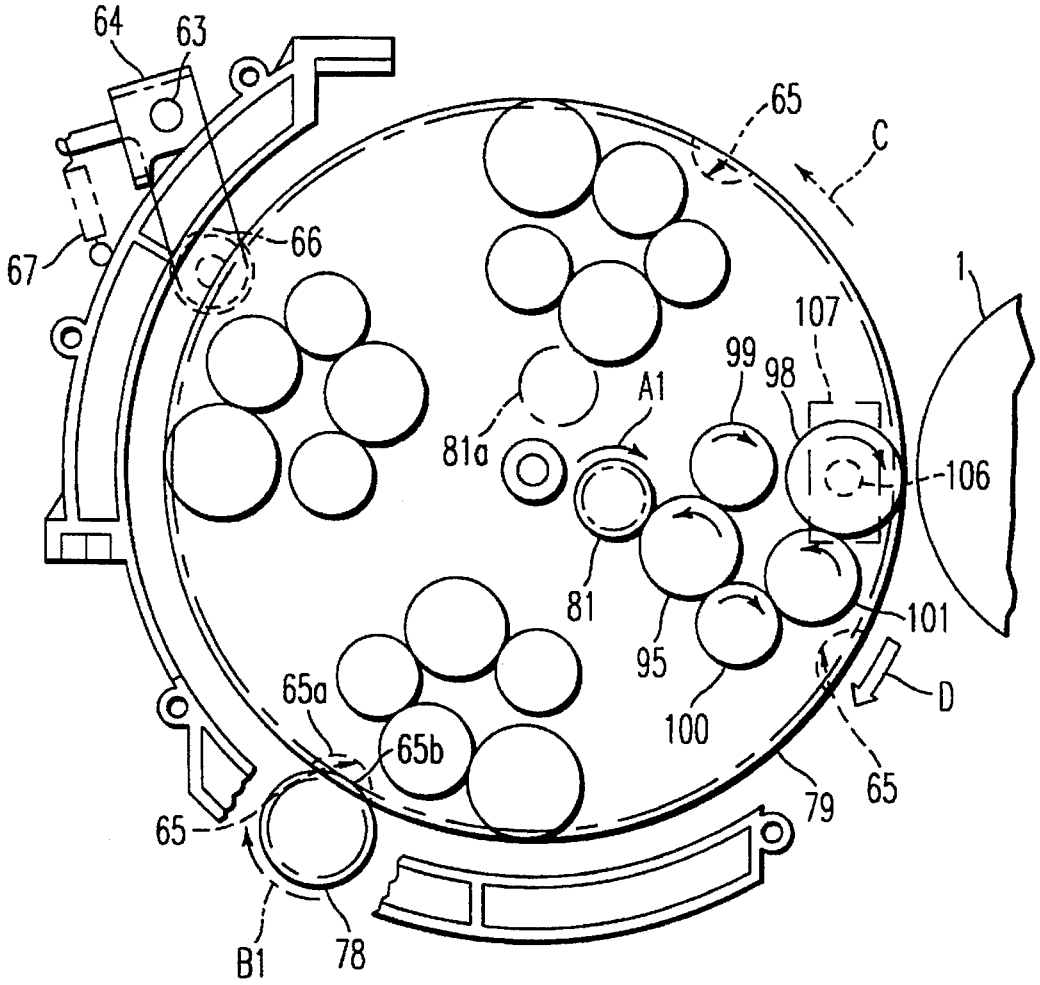
FIG. 5(*a*) is a perspective front view showing a driveline included in the developing unit.
Figure 5B:
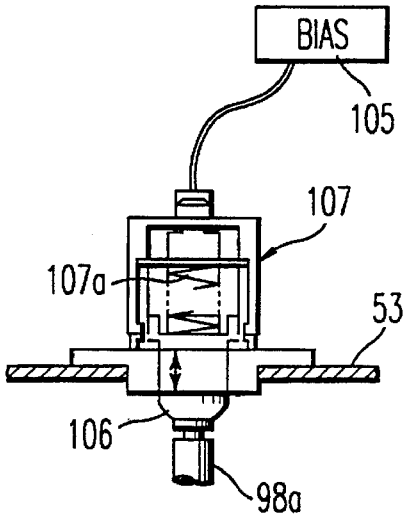

FIG. 5(*a*) shows a mechanism for rotating the developing rollers and other rotary bodies of the developing unit 40. As shown, various gears are mounted on the wall 51 at the rear of the revolver input gear 79. The shaft of the developing roller 84 extends throughout the wall 51 to the rear of the input gear 79. A gear 98 is mounted on the protruding end of the shaft of the roller 84. Likewise, the shafts of the screws 86 and 91 extend throughout the wall 51 to the rear of the input gear 79. Gears 99 and 100 are mounted on the protruding ends of the screws 86 and 91, respectively. An idler gear 101 is mounted on the rear of the wall 51 and held in mesh with the gears 98 and 100. An input gear 95 is also mounted on the rear of the wall 51 and engageable with the output gear 81. The revolver, carrying such gears on the wall 51 thereof, is received in the casing 46 and then inserted into the printer body, as stated earlier. As a result, the input gear 95 of the revolver is brought into mesh with the output gear 81 of the printer body, as shown in FIG. 5(*a*). At the same time, the input gear 79 of the revolver meshes with the output gear 78 of the printer body.

FIG. 5(*a*) shows a condition wherein the gears stated above are in full mesh with each other. In this condition, the output gear 81 is rotated in a direction A1 with the result that the gears 99 and 100 are rotated via the input gear 95. The gears 99 and 100 cause the screws 86 and 91 to rotate. Further, the gear 98 is rotated via the input gear 95, gear 100 and idler gear 101 and, in turn, rotates the developing roller 84.

To replace the developing chamber to be used, the output gear 78 is rotated in a direction B1, FIG. 5(*a*), to thereby rotate the revolver in a direction C. Then, the roller 66 falls in one of the recesses 65 which is formed in the outer periphery of the rear end wall 51 of the revolver. After the positioning of the revolver, when the gear 81 is rotated in the direction A1, a moment of rotation acts on the revolver in a direction indicated by an arrow D. To position the revolver by overcoming the moment, each recess 65 may preferably be made up of two portions 65a and 65b; the portion 65b can have a smaller inclination than the portion 65a. The roller 66 easily leaves the recess 65 via the portion 65a during usual revolution. The other portion 65b is used to lock the revolver.

As shown in FIGS. 5(*a*) and 5(*b*), a bracket 107 is mounted on the printer rear panel 53 at a position facing the developing roller shaft 98a when the shaft 98a is brought to the developing position. A rod-like terminal 106 is supported by the bracket 107 in such a manner as to be retractable by control of bias element 105 in the sliding direction of the casing 46. A spring 107a constantly biases the terminal 106 forward.

Figure 7:
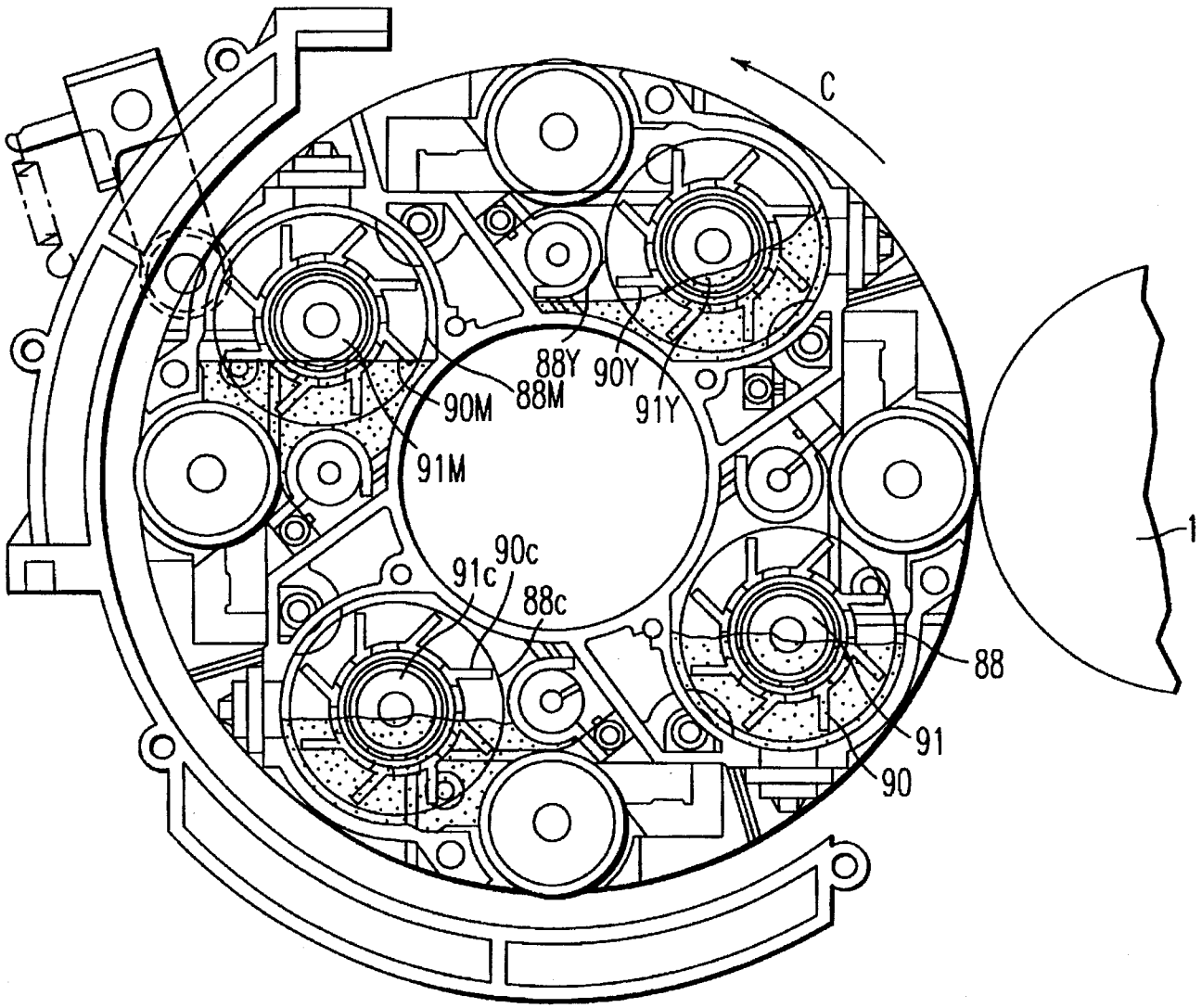
FIG. 7 demonstrates how a developer is agitated in the developing unit in the vertical direction.

During the rotation of the revolver described above, the developer is agitated in the vertical direction by the guide 87 as well as by the other members. Specifically, as shown in FIG. 7 by way of example, when the revolver is rotated counterclockwise, the developer accumulated on the guide 87 due to development at the developing position is discharged from the guide 87, as represented by the chamber rotated 90 degrees away from the developing position in the counterclockwise direction. Then, this part of the developer is mixed and agitated with the developer existing in the chamber in the vertical direction, as represented by the chambers 180 degrees and 270 degrees remote from the developing chamber. When the revolver is fully rotated 360 degrees to the developing position, the developer removed by the doctor blade during development is again received by the guide and then conveyed by the upper screw.

Figure 6:
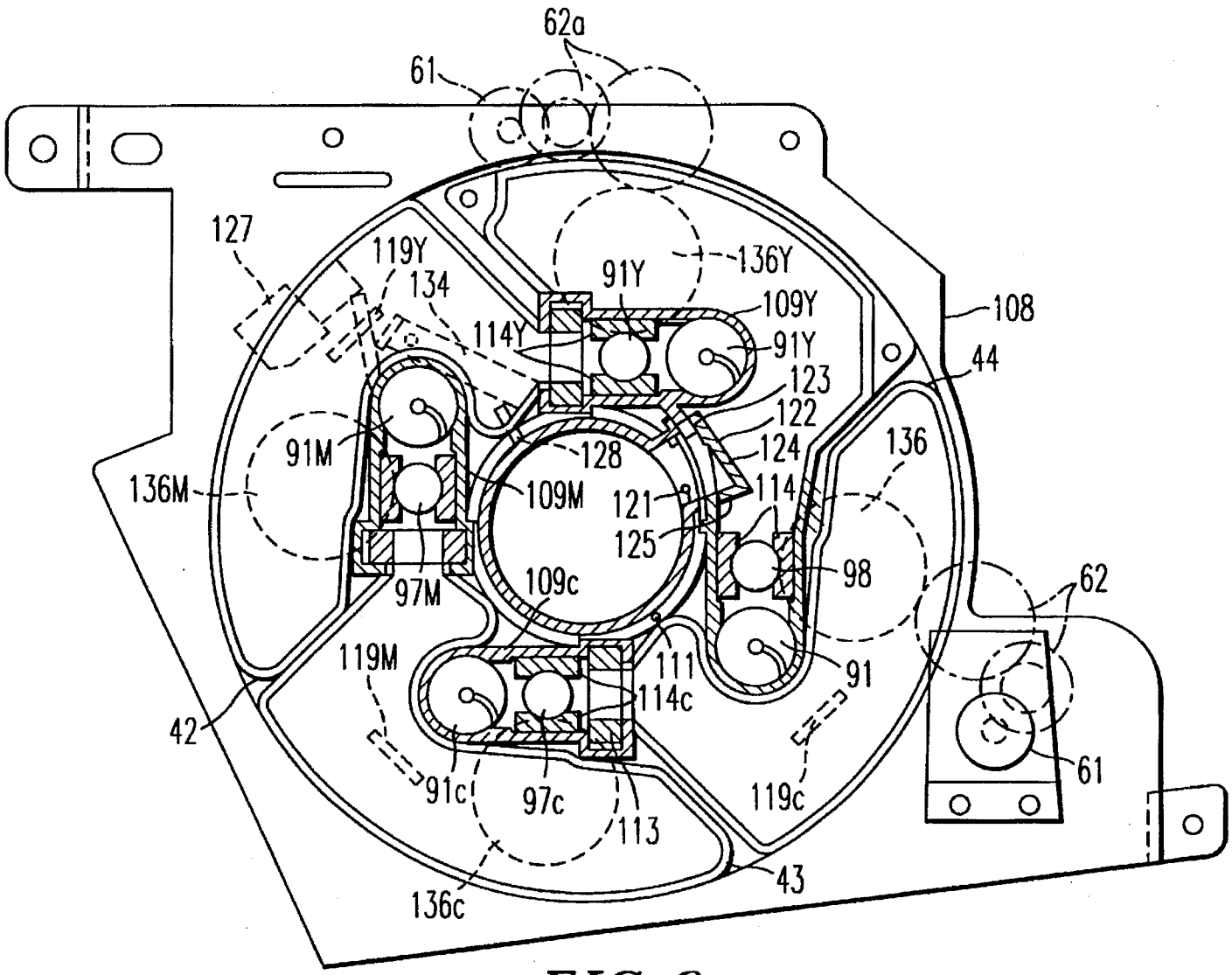
FIG. 6 is a section showing the internal arrangement of a toner storing unit also included in the embodiment.

As noted above, in the arrangement of the present invention, the developing unit and the storing unit 45 can be both turned together. Assuming that the arrangement as illustrated in FIG. 5(*a*) is turned clockwise while the screw 86 and the screw 91 don't rotate, developer near the screws 86 and 91 move. The developer near the screw 86 will move from right to left with respect to FIG. 4(*a*), while the developer near the screw 91 moves from left to right with respect to FIG. 4(*a*). This developer will fill the neighborhood of the screw 86 while a lot of developer near the screw 86 will move. On the other hand, there will not be much developer near the screw 91a and there will not be a large quantity of the moving developer near the screw 91a. As rotation continues, the developer from the screw 86 will fill into the drop section 96. As a result, the developer from the screw 86 flows backward to the toner receptacle 110. A large amount of carrier is contained in the developer near the screw 86 and the carrier can approach a position between rollers 97 and a seal member 114 (114Y, 114C) (FIG. 6). This approaching carrier can adversely affect the seal member 114.

A reference will be made to FIG. 6 for describing the toner storing unit 45. As shown, the storing unit 45 has a disk-like base plate 108 (see also FIG. 2). Four receptacles, or cases, 109Y, 109M, 109C and 110 are affixed to the front end of the base plate 108, and each corresponds to one of the chambers of the developing unit 40. Toner supply rollers 97Y, 97M, 97C and 97 are disposed in the receptacles 109Y, 109M, 109C and 110, respectively. The rollers 97Y–97 are journalled to the base plate 108 and the front walls of the associated receptacles 109Y–110 such that they will be each positioned substantially just above the extension of the screw 91 when the corresponding chamber is brought to the developing position.

The base plate 108 is formed with a circular through hole 111 at the center thereof. The hole 111 allows the cylindrical black toner container to be passed therethrough. The receptacles 109Y–110 are so positioned as not to interfere with the hole 111. Also formed in the base plate 108 are through holes for the lower screws 91 each extending into one of the receptacles 109Y–111 through the base plate 108.

The shafts of the rollers 97Y–97 are journalled to the base plate 108. A gear 197 is mounted on the end of a shaft extending throughout the base plate 108 toward the developing unit 40 (see FIG. 4(*a*)). As shown in FIG. 6, an input gear 136 (136Y, 136M, 136C) is held in mesh with the gear 197. The gears 197 and 136 are assigned to each of the rollers 97Y–97. As shown in FIG. 6, when one developing chamber of the developing unit 40 is brought to the developing position, the input gear 136 corresponding to the chamber is brought into mesh with the gear 62 which is driven by the motor 61. Toner replenishment control is effected by controlling the motor 61.

The receptacles 109Y, 109M and 109C assigned to the color developing chambers have an identical configuration.

As shown in FIG. 6, the cyan toner receptacle 109C, for example, has a wall surrounding the portion of the lower screw 91C present in the receptacle 109C. The wall is formed with a toner inlet at such a position that the inlet overlies the toner supply roller 97C when the associated chamber is located at the developing position. The inlet is surrounded by a mount portion 113. The cyan toner container 44 is mounted to the mount portion 113 with the outlet thereof facing downward, by being slid in the axial direction of the revolver. Seal members 114C are fitted on part of the inner periphery of the receptacle 109C which face the roller 97C. The seal members 114C and roller 97C divide the interior of the mount portion 113 into two portions respectively adjoining the toner container 44 and the chamber. In addition, the seal members 114C and the wall, surrounding the roller 97C and screw 91C, define the previously mentioned communication chamber which is communicated to the associated developing chamber via the hole of the base plate and drop section. The rollers 97Y–97 each includes a roller portion formed with a plurality of axial grooves.

The containers 42–44 are each configured to be engageable with the wall of the receptacle located upstream, in the direction of rotation of the revolver, of the receptacle to which it corresponds. Lugs 119Y, 119M and 119C are respectively formed on the outer surface of the rear wall 51, and each is sensed by a respective set sensor.

The receptacle 110 assigned to the black developing chamber has a far greater space than the receptacles 109Y–109C assigned to the color developing chambers. Specifically, as shown in FIG. 6, the receptacle 110 has a wall substantially identical with the contour of the color toner receptacle 109Y, 109M and 109C and color toner container 42, 43 or 44 mounted thereto. Seal members 114 are fitted on the inner periphery of the portion of the receptacle 110 corresponding to the receptacle. Also, the seal members 114 define a communication chamber communicated to the associated developing chamber in cooperation with the wall surrounding the screw 91. The wall portion similar to the color toner container is formed with a toner inlet 122 in part thereof which faces the center line of the revolver. The toner inlet 122 is identical in shape with the toner outlet 121 of the container 41. Black toner is received from the container 41 via the inlet 122. A shutter 124 is rotatably supported at one end by a shaft 123 parallel to the axis of the revolver. A seal member 125 is fitted in the edge of the shutter 124.

The black toner container 41 is cylindrical and has the outlet 121 formed in the circumferential wall of one end portion thereof. A spiral ridge is formed in the inner periphery of the container 41 from the end remote from the outlet 121 toward the outlet 121. When the container 41 is mounted to the revolver, the ridge rotates integrally with the revolver so as to feed the toner from the rear end toward the outlet 121. A lug 128 to be sensed is provided on the outer periphery of the container 41 at the rear of the outlet 121.

Specifically, the cover 47 is formed with a notch 130 and a notch **47*a* for the insertion of the container 41. The container 41 is positioned such that the outlet 121 faces upward. After the seal member closing the outlet 121 has been removed, the container 41 is inserted into the revolver through the notch 47*a* with the lug 128 thereof aligned with the notch 130. The container 41 is inserted to the deepest position where the rear end is received in the hollow cylindrical portion 82 of the developing unit 40, and where the front end is substantially flush with the front walls of the receptacles of the storing unit 40. Then, the container 41 is rotated clockwise, as viewed in the figures, about its own axis with a grip portion thereof held by hand, until the outlet 121 aligns with the inlet 122. This rotation will be referred to as a set rotation hereinafter. During the set rotation, the lug 128 is sensed by a link 134 mounted on the revolver, specifically on the rear of the casing front wall 48, and a set sensor 127. The link 134 is rotatable about a fulcrum 123**.

As stated above, the developer accumulated in the guide 87 is discharged and agitated in the vertical direction due to the rotation of the revolver. During the course of development, the toner from the container is charged by being agitated in the hollow tubular portion of the paddle and then fed to the developing chamber. The embodiment, therefore, ensures desirable development.

A reference will be made to FIG. 6 for describing a modification of the embodiment in which the toner is replenished into the developing chamber at a position different from the developing position. In the above embodiment, the motor 61 is located at a position for driving the gear 197 of the screw 91 associated with the chamber which is brought to the developing position, while the toner from the container is fed into the chamber after being charged beforehand. However, when the toner is replenished during development, there is some fear that the toner contaminates, for example, the background of an image due to short charging. It is, therefore, preferable to effect the replenishment at a position other than the developing position. When the storing unit 45 rotates integrally with the developing unit 40, as in the embodiment, it is necessary to select the replenishing position in consideration of the movement of the toner in the containers and receptacles. Specifically, the prerequisite is that the toner conveying means consisting of the replenishing roller and lower screw, particularly the replenishing roller, be positioned in the range of the container and receptacle where the toner is present. Stated another way, each replenishing roller should be so arranged as to exist in the above range when the associated chamber is present at at least one angular position other than the developing position.

In light of the above, as indicated by dash-and-dots lines in FIG. 6, the motor 61 and transmission gears **62*a* are so positioned as to drive the replenishing roller (97Y** in the condition shown in the figure) associated with the chamber which has been rotated 90 degrees away from the developing position in the counterclockwise direction.

Figure 8:
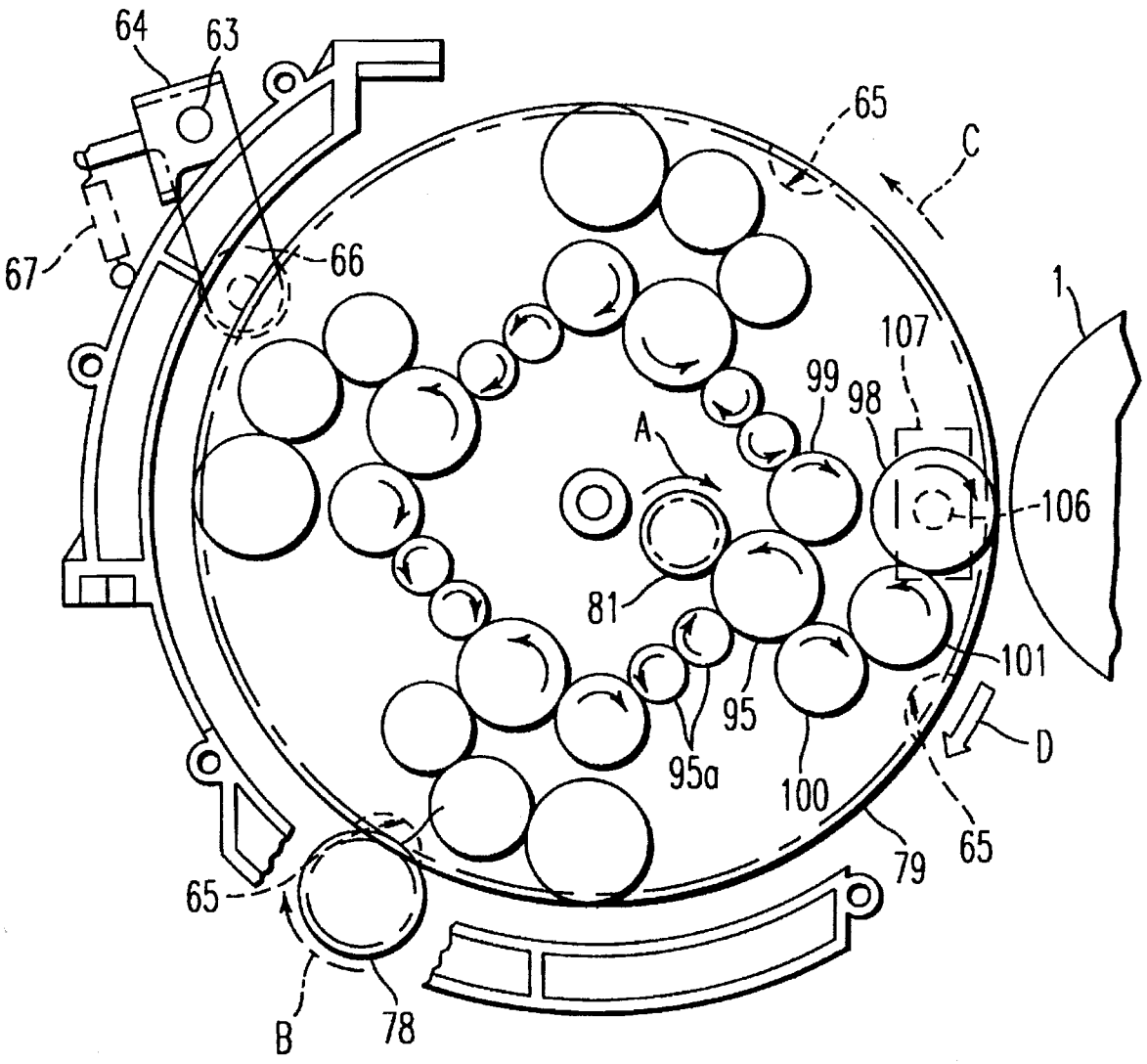
FIG. 8 is a perspective front view of a driveline included in a modification of the embodiment.

To replenish the toner, not only the replenishing roller but also the lower screw, preferably the upper and lower screws, must be rotated. The screws of the chamber located at the replenishing position may be drive by any one of the following schemes. For example, as indicated by a dash-and-dots line in FIG. 5(*a*), a drive gear **81*a* may be added in order to directly transfer the torque to the chamber brought to the replenishing position. Alternatively, as shown in FIG. 8, intermediate gears 95*a* may be mounted on the rear wall 51 of the developing unit 40 and transfer the torque input to the chamber located at the developing position to the other chambers. Particularly, the scheme shown in FIG. 8 is desirable from the vibration standpoint because the drive gear 81 and input gear 95** should only be brought into and out of mesh at a single position, i.e., at the chamber located at the developing position.

The additional arrangement shown in FIG. 5(*a*) or 8 is useful alone even if it is isolated from the toner replenishment, as follows. When the developer is agitated only at the developing position, the agitation is apt to be short because the revolver must be rotated for switching the color. By driving the screws even at the positions other than the developing position, it is possible to obviate the short agitation. This can be done with the drive arrangement of FIG. 5(*a*) or 8. Again, the arrangement of FIG. 8 is advantageous in the vibration aspect. Particularly, the scheme shown in FIG. 8 allows all of the four chambers to be driven at the same time.

The agitation in the chambers not located at the developing position should preferably be effected at a high speed in order to enhance the efficiency. Specifically, when the gear 81*a* is added, as shown in FIG. 5(*a*), it may be rotated at a higher speed than the drive gear 81 assigned to the developing position. When the intermediate gears 95*a* are used, as shown in FIG. 8, the gear ratio of the gears 95*a* may be selected such that the screws in the chambers not located at the developing position rotate at a higher speed than the screws in the chamber located at the developing position. It is to be noted that the agitation speed available in the chamber at the developing position is limited in relation to the developing characteristic.

Figure 9A:
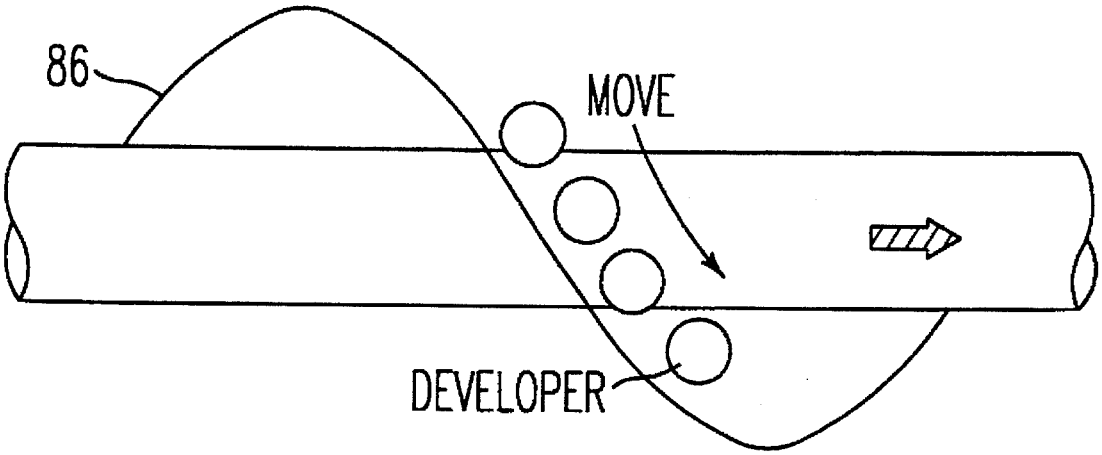
FIGS. 9(*a*) and 9(*b*) are schematic diagrams showing toner movement along the lower screw.
Figure 9B:
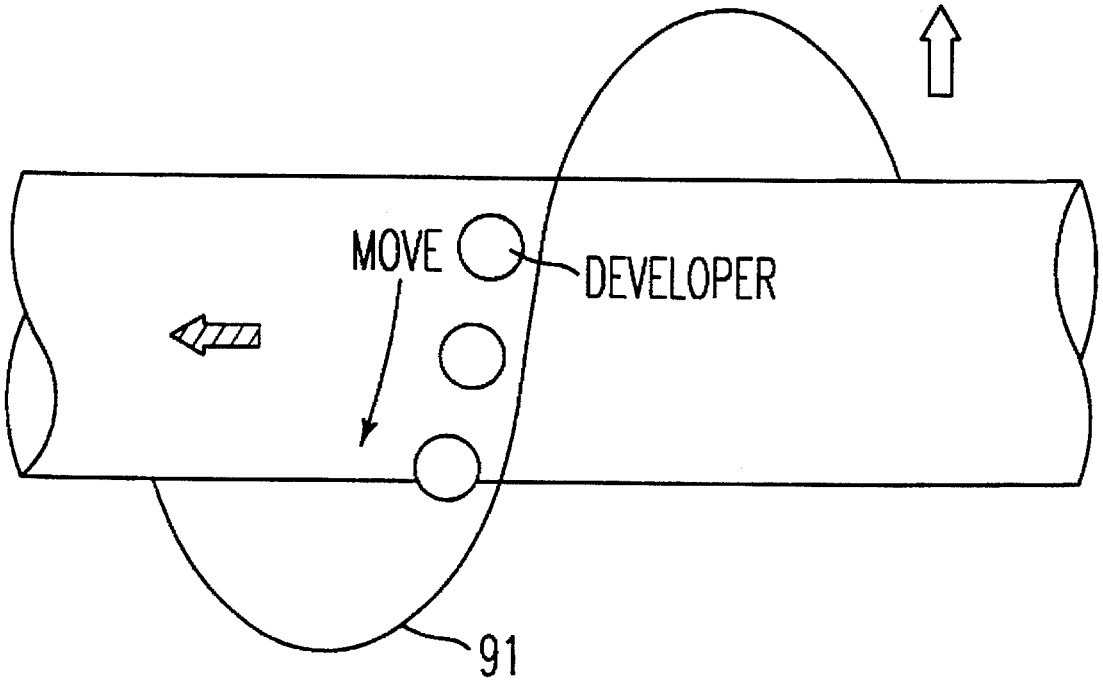

The schematic illustration of FIGS. 9(*a*) and 9(*b*) is an example of the effect of the arrangement of the present invention with respect to a rotation of the developing unit and storage unit in the direction C of FIG. 5(*a*). As illustrated in FIGS. 9(*a*) and 9(*b*), during the rotation of the developer storage unit and the developing unit in the direction C, developer along the screw 86 when it is not rotating will move from left to right as illustrated in FIG. 9(*a*), while developer along the screw 91 when it is not rotating will move from right to left as illustrated in FIG. 9(*b*). This therefore conveys developer (especially carrier) near the screw 86 in the opposite direction of the toner storage unit so as to not adversely affect the toner storage unit. The developing unit turns counterclockwise (direction C) in order to situate the developing unit with colored toner at the developing position. In order to fill black toners in the developer storing unit from a center black toner bottle, one merely rotates the rotor in the developing unit.

Figure 10:
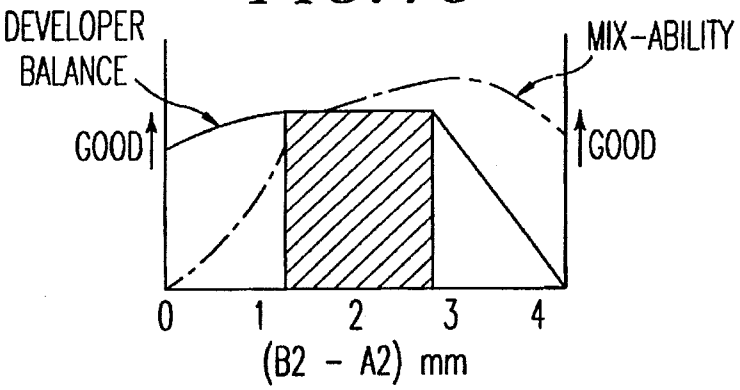
FIG. 10 illustrates a graph showing developer balance characteristics.

A further feature of the present invention can be illustrated in FIGS. 4(*b*), 4(*c*), 4(*d*) and 10. In the present invention, the paddle 88 can have a diameter A2 while the screw member 88*a* can have a diameter B2. The developer balance as illustrated in the graph of FIG. 10 shows a balance characteristic with respect to developing quantity between the side of the toner storage unit 45 and the side of the back of it. FIG. 10 can be utilized to show the condition of good developer balance as shown by the arrow. When (B2-A2) is approximately 0–1 mm, the condition in which developer does not move from the side of the front is shown. When (B2-A2) is approximately 3–4 mm, a condition in which the developer moves too much to a side of the back is shown. Also, mixability as illustrated in the graph of FIG. 10 shows the degree of the mixing of toners and carriers in the developing unit. As illustrated, a good mixability is shown and occurs when the toners and the carriers are mixing well in the developing unit. The bigger (B2-A2) becomes, the better the mixability becomes. Therefore, it is desirable to place (B2-A2) in the range of 1–3 mm.

Figure 11:
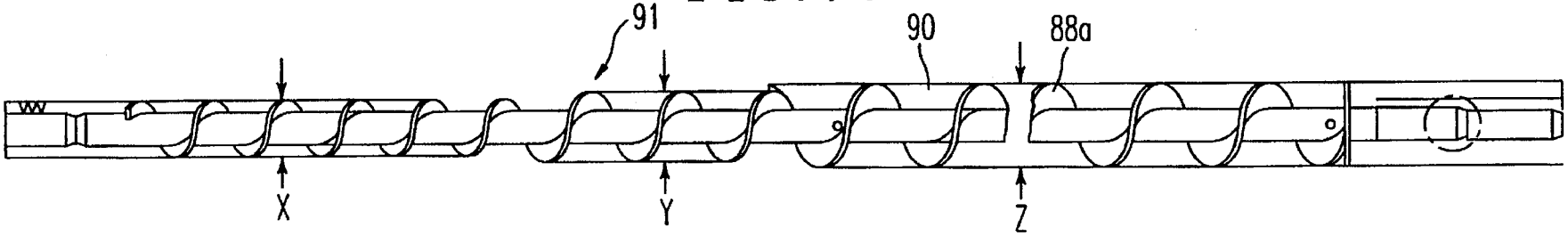
FIG. 11 shows a further embodiment of the lower screw.

A further feature of the present invention is illustrated in FIG. 11. In FIG. 11, the diameter of a portion of the screw 91 which corresponds to the receptacle 110 is shown by the letter X. The diameter of the portion of the screw 91 which corresponds to the drop section 96 is represented by the letter Y. The diameter of the portion of the screw 91 which corresponds to the developing part or developing unit 40 is represented by the letter Z. So as to provide for an aggressive and efficient mixture of developer, the diameters as noted above should be X<Y<Z.

In the portion of the screw 91 represented by the diameter X, there is not much toner quantity which is conveyed due to the conveyance of only the toner. This portion of the screw basically provides for toner conveyance.

In the portion of the screw 91 having the diameter Y, it is noted that the developer (carriers) begin to be mixed, and the quantity of the developer increases. To convey a large amount of developer, it is necessary to make this diameter bigger than X.

In a portion of the screw 91 having the diameter Z, this diameter is necessary to aggressively mix the developers which have been in the hollow part and the developer which is newly added. Therefore, this diameter is bigger than the diameters X and Y. Also, a lot of developer must be conveyed at this part.

Additionally, the pitch of the portion of the screw 91 having the diameter Z becomes bigger than the other parts as shown in FIG. 11. This is due to the fact that developers in which friction was charged in the part of the screw 91 having the diameter Y must be quickly conveyed into the developing receptacle. That is, it charges the developer sufficiently in the portion of the screw 91 having the diameter Y, and it quickly conveys the developer in the portion of the screw 91 having the diameter Z. Therefore, the toners are charged sufficiently and are able to be quickly conveyed to the development area.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A rotary developing device comprising:

a developing unit having a plurality of developing chambers arranged around an axis of rotation, and rotatable about said axis to move any one of said plurality of developing chambers to a developing position where an image carrier is located;

a developer storing unit comprising a plurality of developer receptacles respectively corresponding to said plurality of developing chambers; and conveying means for conveying a developer from each of said developer receptacles to one of said plurality of developing chambers;

wherein a rotatable hollow member is disposed in each of said plurality of developing chambers and formed with a plurality of agitating blades, each extending over a width of an effective developing range, at predetermined circumferential intervals, wherein said conveying means extends in said hollow member over said width, and wherein said hollow member is formed with developer outlets in a circumferential wall thereof, said rotatable hollow member further comprising a conveying screw member which extends along the width of the effective developing range;

wherein said developer outlets are confined in a range of from an intermediate portion to a downstream end of said circumferential wall in a direction in which said conveying means conveys the developer.

2. A device as claimed in claim 1, wherein a difference between a diameter of the conveying screw member and a diameter of the blades is within a range of 1–3 mm.

3. A device as claimed in claim 1, wherein said conveying screw member of said rotatable hollow member and said conveying means convey developer in the same direction.

4. A rotary developing device comprising:

a developing unit having a plurality of developing chambers arranged around an axis of rotation, and rotatable about said axis to move any one of said plurality of developing chambers to a developing position where an image carrier is located;

a developer storing unit comprising a plurality of developer receptacles respectively corresponding to said plurality of developing chambers; and conveying means for conveying a developer from each of said developer receptacles to one of said plurality of developing chambers;

wherein a rotatable hollow member is disposed in each of said plurality of developing chambers and formed with a plurality of agitating blades, each extending over a width of an effective developing range, at predetermined circumferential intervals, wherein said conveying means extends in said hollow member over said width, and wherein said hollow member is formed with developer outlets in a circumferential wall thereof, said rotatable hollow member further comprising a conveying screw member which extends along the width of the effective developing range;

wherein said hollow member further comprises small holes positioned upstream of said developer outlets with respect to a direction in which the conveying means conveys the developer.

5. A device as claimed in claim 4, wherein said developer outlets are confined in a range of from an intermediate portion to a downstream end of said circumferential wall in a direction in which said conveying means conveys the developer.

6. A device as claimed in claim 4, wherein a difference between a diameter of the conveying screw member and a diameter of the blades is within a range of 1–3 mm.

7. A rotary developing device comprising:

a developing unit having a plurality of developing chambers arranged around an axis of rotation, and rotatable about said axis to move any one of said plurality of developing chambers to a developing position where an image carrier is located;

a developer storing unit comprising a plurality of developer receptacles respectively corresponding to said plurality of developing chambers; and conveying means for conveying a developer from each of said developer receptacles to one of said plurality of developing chambers;

wherein a rotatable hollow member is disposed in each of said plurality of developing chambers and formed with a plurality of agitating blades, each extending over a width of an effective developing range, at predetermined circumferential intervals, wherein said conveying means extends in said hollow member over said width, and wherein said hollow member is formed with developer outlets in a circumferential wall thereof, said rotatable hollow member further comprising a conveying screw member which extends along the width of the effective developing range;

wherein a portion of the conveying means which corresponds to the developer storing unit has a diameter X, a portion of the conveying means which corresponds to a drop section located downstream of the developer storing unit, with respect to the conveying direction, has a diameter Y, and a portion of the conveying means which corresponds to the developing unit and is positioned downstream of the drop section, with respect to the conveying direction, has a diameter Z, wherein:

$$X<Y<Z.$$

8. A device as claimed in claim 7, wherein said developer outlets are confined in a range of from an intermediate portion to a downstream end of said circumferential wall in a direction in which said conveying means conveys the developer.

9. A device as claimed in claim 7, wherein a difference between a diameter of the conveying screw member and a diameter of the blades is within a range of 1–3 mm.

10. A rotary developing device comprising:

a developing unit having a plurality of developing chambers arranged around an axis of rotation, and rotatable about said axis to move any one of said plurality of developing chambers to a developing position where an image carrier is located;

a developer storing unit comprising a plurality of developer receptacles respectively corresponding to said plurality of developing chambers; and conveying means for conveying a developer from each of said developer receptacles to one of said plurality of developing chambers;

wherein a rotatable hollow member is disposed in each of said plurality of developing chambers and formed with a plurality of agitating blades, each extending over a width of an effective developing range, at predetermined circumferential intervals, wherein said conveying means extends in said hollow member over said width, and wherein said hollow member is formed with developer outlets in a circumferential wall thereof, said rotatable hollow member further comprising a conveying screw member which extends along the width of the effective developing range;

the device further comprising a second conveying means which conveys developer to the developer storing unit, said second conveying means having screw means which is configured to move toner away from the developer storing unit when the screw means is stationary and the developer storing unit and the developing unit are being rotated.

11. A device as claimed in claim 10, wherein said developer outlets are confined in a range of from an intermediate portion to a downstream end of said circumferential wall in a direction in which said conveying means conveys the developer.

12. A device as claimed in claim 10, wherein a difference between a diameter of the conveying screw member and a diameter of the blades is within a range of 1–3 mm.

* * * * *